United States Patent [19]

Matucheski et al.

[11] 4,242,046

[45] Dec. 30, 1980

[54] FAN SPIDER WITH RAKE ANGLE

[75] Inventors: Joseph V. Matucheski; Clifford S. L. Yee; Michael T. Spellman; Donald J. Hartley, all of Indianapolis; William D. Barton, Plainfield, all of Ind.

[73] Assignee: Wallace Murray Corporation, New York, N.Y.

[21] Appl. No.: 915,790

[22] Filed: Jun. 15, 1978

[51] Int. Cl.[3] ..... F04D 29/38

[52] U.S. Cl. ..... 416/132 A; 416/202

[58] Field of Search ..... 416/132 R, 132 A, 202, 416/210 R, 169 A; 123/41.11, 41.49, 41.64, 41.65

[56] References Cited

U.S. PATENT DOCUMENTS

| | | | |
|---|---|---|---|
| 2,132,133 | 10/1938 | Smith | 416/132 A |
| 3,044,557 | 7/1962 | Posh | 416/132 A |
| 3,728,043 | 4/1973 | Pratiniphi | 416/132 A |
| 3,901,625 | 8/1975 | Witzel | 416/132 A |
| 3,914,069 | 10/1975 | Arrington et al. | 416/132 A |
| 4,037,987 | 7/1977 | Charles et al. | 416/132 A |
| 4,147,471 | 4/1979 | Charles | 416/132 A |

*Primary Examiner*—Everette A. Powell, Jr.

*Attorney, Agent, or Firm*—Thomas J. Greer, Jr.

[57] ABSTRACT

A sheet metal construction for a fan spider. The spider arms each carry an integral rib running centrally along the arm and each rib is flat on its upper surface to mount a fan blade. The novelty of the invention resides in canting forwardly the spider arms. Such canting reduces certain stresses in the fan, thereby reducing cost of manufacture.

6 Claims, 4 Drawing Figures

FAN SPIDER WITH RAKE ANGLE

This invention relates to the art of impeller construction and more particularly to a hub or spider construction for a sheet metal fan. The sheet metal fans of the type herein described exhibit particular utility for cooling the radiator system of an internal combustion engine. In the usual internal combustion engine, a heat exchange liquid such as water is pumped into and out of cavities or passages within the engine block, the water passing continuously to and from the radiator core. Air is moved by the cooling fan over the radiator core, thus cooling the core and the water or other liquid carried through it. The now cooled liquid is then returned to the engine block, such circulation taking place for the purpose of preventing extremely high temperature build-up of the engine block during operation. The cooling fan is generally driven by a belt coupled to the engine so that the cooling action of the fan takes place concurrently with operation of the engine.

A great variety of constructions for such cooling fans is known. Such variations may include, for example, configurations or shapes of the fan blades themselves as well as other variations which include the degree of rotational coupling between the fan and the engine. The variation introduced by the practice of this invention relates to a novel hub or so-called spider.

According to the practice of this invention, the fan blades of the radiator cooling fan are constructed of relatively thin sheet metal and are attached, individually, to a corresponding arm of a hub or so-called spider, as is conventional. The spider arms are canted forwardly at an angle (rake angle) to a radius, the cant being towards the direction of rotation. By virtue of the cant, the net bending moment (normal to the plane of the spider) of the spider arm at its root portion is reduced. Such bending moments are caused by centrifugal forces which arise during rotation of the fan. The invention is useful in fan constructions, such as flexible bladed fans, wherein the center of mass of each fan blade is usually laterally offset with respect to the center of the root section of the spider arm upon which it is mounted. The canted spider arm construction offers savings in the quantity of metal which must be employed to construct a radiator cooling fan having the desired structural integrity, and accordingly lessens the cost of manufacture.

Figure 1:
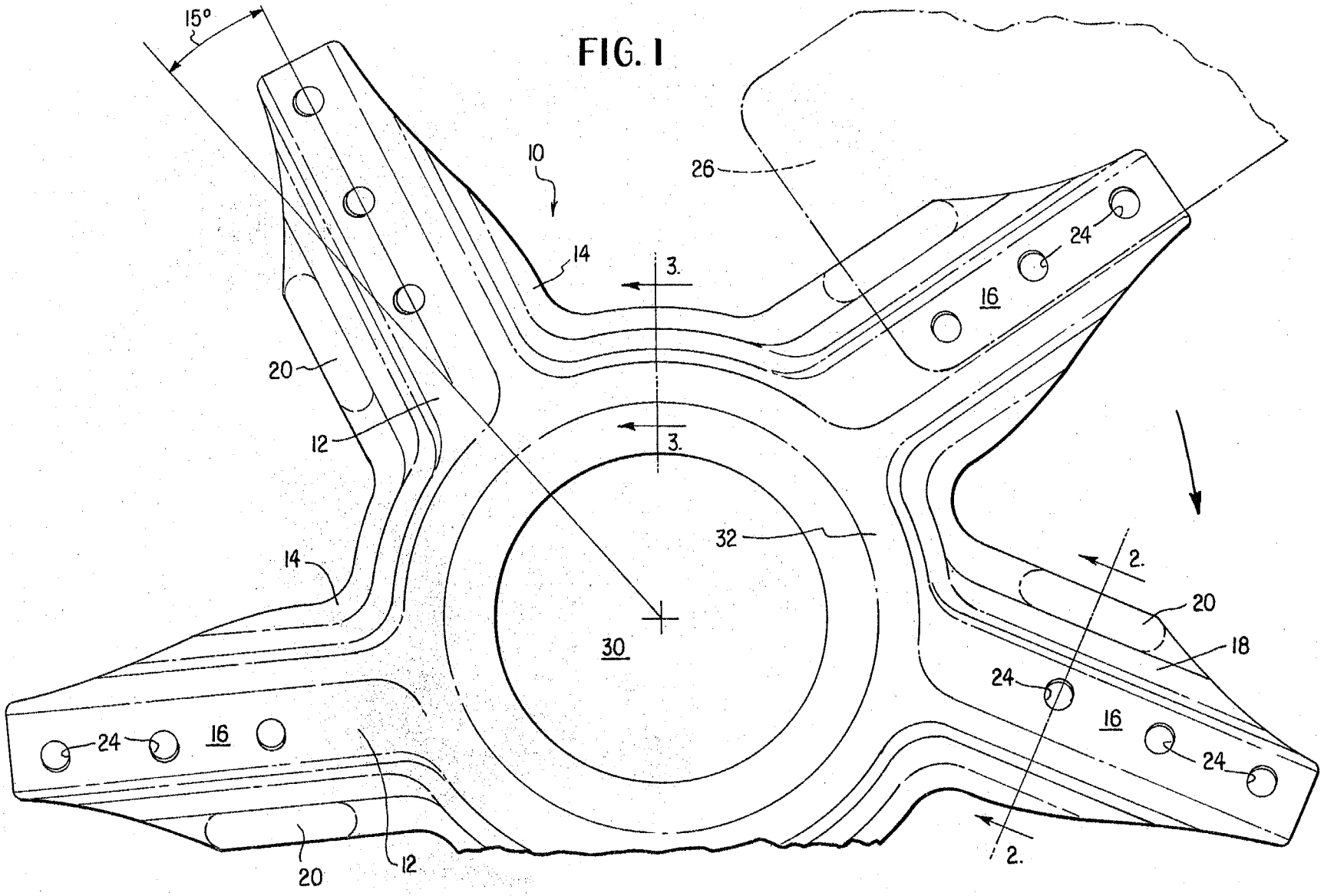
FIG. 1 is a plan view of a sheet metal spider having forwardly canted arms in accordance with the practice of this invention.

Referring now to the drawings, the numeral 10 denotes generally a fan spider molded or formed of relatively thick sheet material such as sheet metal or a reinforced plastic. The numeral 12 denotes any one of a plurality of generally radially extending arms which are integral with the hub or spider. The reader will observe that the arms are canted forwardly at an angle of approximately 15 degrees with respect to a true radial line. The numeral 14 denotes an edge of any one of the arms 12 at a region adjacent its base. The numeral 16 denotes a raised rib running longitudinally of each arm and generally centrally thereof. It will be observed that the upper surface of each rib is flat. The numeral 18 denotes that portion of the arm which is connected to the lowest portion of rib 16, while portion 20 denotes the remaining base portion of the arm on the side opposite from portion 14. The numeral 24 denotes any one of a plurality of apertures pre-formed on each arm, centrally thereof and longitudinally spaced therealone for the purpose of accommodating rivets or other fastening elements. The numeral 26 at FIG. 1 indicates, in dashed lines, the outline of a portion of a typical fan blade attached to one of the arms of the spider. In a typical embodiment the spider or hub is formed of sheet metal approximately 0.105 inches thick. Each arm is of a length approximately 3 inches and of a width of approximately 2.00 inches.

The angle between the flat fastening surface of rib 16 and the plane of the leading and trailing edges of each arm, in a typical embodiment, is 19 degrees. The spider may be formed by the use of suitable stamping dies.

The prior art is aware of a number of fan constructions wherein portions of the above-described fan are shown. The reader is referred to the following U.S. Pat. Nos. 1,423,717 to Hicks, 1,818,607 to Campbell, 1,868,528 to Gardner, 2,620,039 to Allen, 3,628,888 to Wooden, 3,711,219 to Strick, 3,887,300 to Quinn. In general, the construction above described is conventional.

Figure 2:
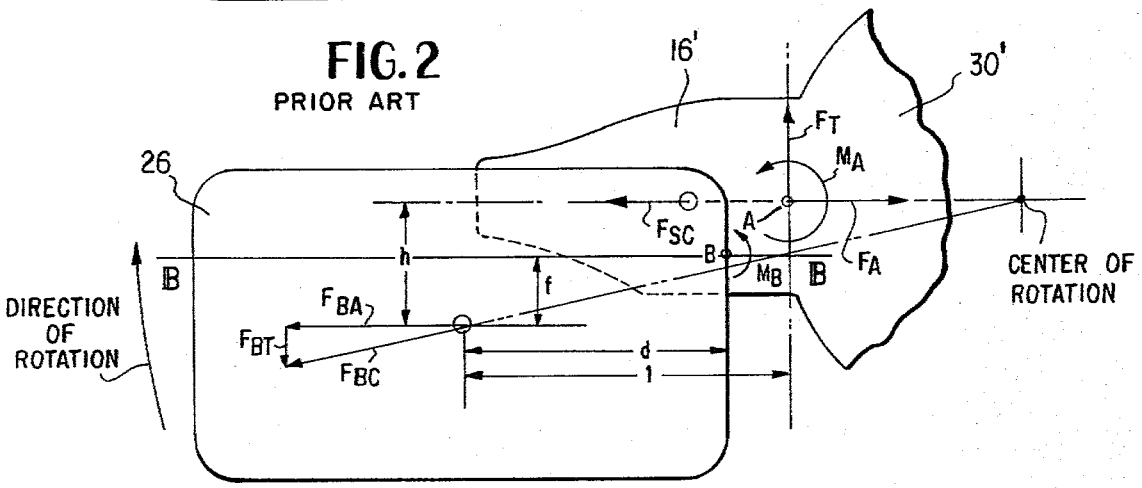
FIG. 2 PRIOR ART

Referring now to FIG. 2 of the drawings, a vector representation of certain dynamic forces encountered with a typical prior art flexible bladed fan construction is given, i.e., the rake angle being zero. The numeral 26 again denotes an individual fan blade, the numeral 16' the spider arm, and the numeral 30 the spider center. Only one spider arm and a portion of the spider is illustrated. During rotation of the fan, centrifugal force $F_{SC}$ and force $F_{BC}$ acts, respectively, on the spider arm 16' centroid (center of mass) and the blade 26 centroid (center of mass). The oppositely directed, resistive spider arm axial force is denoted by $F_A$. The tangential (shear) force at the spider arm root is denoted by $F_T$. The centrifugal force $F_{BC}$ of the fan blade 26 is shown as acting through its center of mass (centroid), and having components $F_{BT}$ and $F_{BA}$ as indicated. The centroid of the fan blade is laterally (angularly) displaced a distance h from the spider arm axis, and a distance 1 from the root of the spider arm. $M_A$ denotes the net bending moment of the spider arm at its root center A about an axis perpendicular to the plane of the root, i.e., about an axis perpendicular to the plane of the root section, this also being the plane of the paper. The following moment equation is a summation of moments about point A, for the spider arm 16' of the prior art design of FIG. 2.

$$M_A+F_{SC}(\text{zero})+F_{BT}(l)-F_{BA}(h)=0$$

from which $$M_A=F_{BA}(h)-F_{BT}(l) \quad (1)$$

The loads acting on the blade 26 are given by:

$$M_B=F_{BA}(f)-F_{BT}(d) \quad (2)$$

Figure 3:
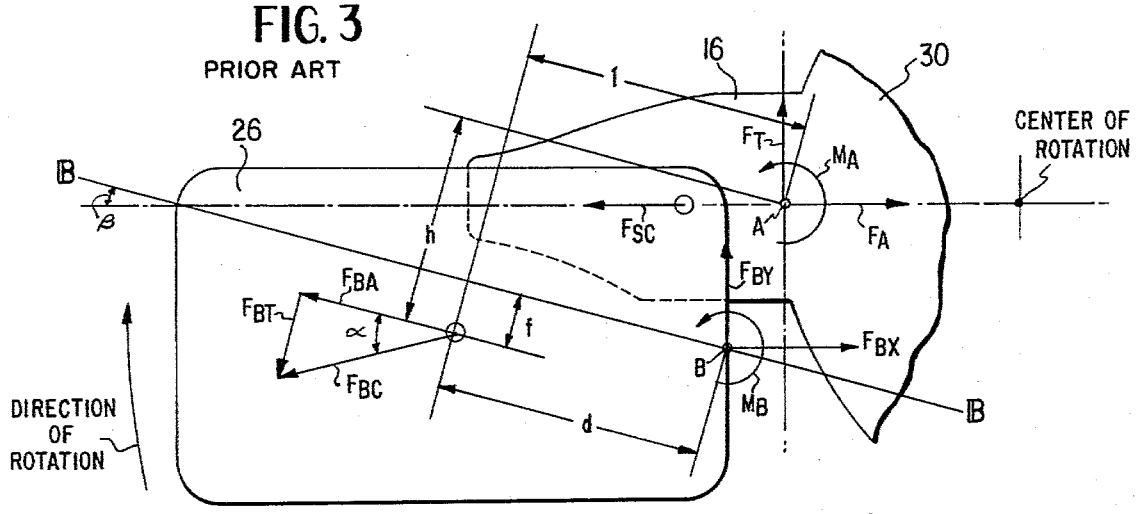
FIG. 3 PRIOR ART
FIGS. 2 and 3 illustrate by means of vectors certain forces present during rotation of typical prior art fans.

Referring now to FIG. 3 another prior art construction is shown, here one wherein the blades 26, but not the spider arms, are forwardly canted. The blade in this case is restricted by some mechanical means (not illustrated) to flex along canted line B—B Equations (3) and (4) describe the loads on the spider arm 16' and the blade 26, respectively.

$$M_A = F_{BA}(h) - F_{BT}(l) \quad (3)$$

$$M_B = F_{BA}(f) - F_{BT}(d) \quad (4)$$

Figure 4:
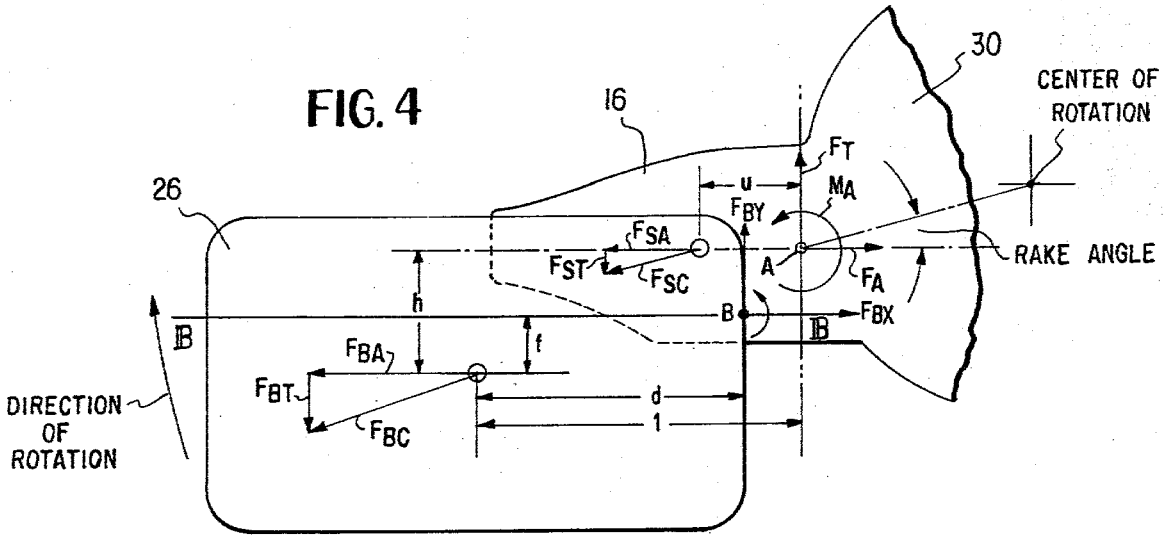
FIG. 4 is a view similar to FIGS. 2 and 3, but illustrating the present fan construction, wherein the spider arms are forwardly canted.

Referring now to FIG. 4, the canted or raked spider arm construction of this invention generates a reduced net moment $M_A$ in comparison with prior art constructions. The rake angle introduces a new moment $F_{ST}(u)$ where u is the axial distance along arm 16 between the arm centroid and root point A. The summation of moments about point A for FIG. 4 is as follows:

$$M_A + F_{SA}(\text{zero}) + F_{ST}(u) + F_{BT}(l) - F_{BA}(h) = 0$$

from which $$M_A = F_{BA}(h) - [F_{BT}(l) + F_{ST}(u)] \quad (5)$$

For the moments about point B:

$$M_B = F_{BA}(f) - F_{BT}(d) \quad (6)$$

A comparison of equations (1) (3) and (5) shows an additional term in equation (5) which has a diminishing effect on the overall bending moment $M_A$. This term is $F_{ST}(u)$ and is a result of the rake or cant angle of the spider arms which generates the centrifugal force $F_{ST}$ upon fan rotation.

In FIGS. 2, 3, and 4, line B—B indicates an axis about which the fan blade flexes. Point B is accordingly the point of maximum flexure of the innermost edge of the blade.

The following table more fully illustrates the advantages of the rake angle construction of this invention.

LOADS AND PRINCIPAL STRESSES
for a fan speed of 6000 rpm.

| | | | PRIOR ART | | | PRACTICE OF THIS INVENTION | |
|---|---|---|---|---|---|---|---|
| | | | Case #1 FIG. 2 RAD. ARM STD. BLADE | Case #2 FIG. 3 RAD. ARM RAKED BLADE | % Change | Case #3 FIG. 4 RAKED SPIDER RAKED BLADE | % Change |
| SPIDER LOADS | | | | | | | |
| (LB) | AXIAL | $F_A$ | 1300.6 | 1243.5 | 4% Reduction | 1266 | 3% Reduction |
| (LB) | TANGENTIAL | $F_T$ | 204 | 330.1 | 62% Increase | 428.4 | 110% Increase |
| (IN.LB) | MOMENT | $M_A$ | 517.3 | 514.8 | 0.5% Reduction | 54.9 | 89% Reduction |
| STRESSES | $\sigma_1$ | Maximum | 13980 | 13749 | 2% Reduction | 6402 | 54% Reduction |
| (PSI) | $\sigma_2$ | Minimum | −47 | −125 | 166% Increase | −451 | 960% Increase |
| | $\tau_{max}$ | Shear | 7014 | 6937 | 1% Reduction | 3427 | 51% Reduction |
| BLADE LOADS | | | | | | | |
| (LB) | AXIAL | $F_{BX}$ | 627.8 | 626.7 | 2% Reduction | 613.5 | 2% Reduction |
| (LB) | TANGENTIAL | $F_{BY}$ | 204 | 207.3 | 2% Increase | 286.1 | 40% Increase |
| (IN.LB) | MOMENT | $M_B$ | 152.2 | 61.5 | 60% Reduction | −77.2 | 151% Reduction |
| STRESSES | $\sigma_1$ | Maximum | 9906 | 7265 | 27% Reduction | 7140 | 28% Reduction |
| (PSI) | $\sigma_2$ | Minimum | −3715 | −4839 | 30% Increase | −5153 | 138% Increase |
| | $\tau_{max}$ | Shear | 6810 | 6052 | 11% Reduction | 6146 | 10% Reduction |

The reader will observe that where h=0, the advantage of the novel construction of FIG. 4 is not present. But for a flexible bladed fan, h is usually not zero.

What is claimed is:

1. A spider construction for a sheet metal fan for use in combination with an internal combustion engine to cool an associated radiator, said spider construction comprising a central spider having a center of rotation and a plurality of like spider arms extending outwardly therefrom, each of said spider arms carrying a separately formed fan blade rigidly mounted thereon; each of said spider arms having a generally radial fan blade mounting line axis, a root section normal to said mounting line axis and disposed adjacent said central spider, and said mounting line axis being canted forward in the intended direction of rotation with respect to a radial line from said center of rotation through the center of said root section and intersecting said radial line at said root section center; and each fan blade having a center of mass angularly displaced in trailing relation to said radial line with the net bending moment at said root section about an axis passing through the center of said root section and parallel to an axis of rotation through said spider center of rotation being less than in like spider constructions wherein said spider arms extend substantially radially.

2. The spider construction of claim 1 wherein each fan blade is secured to its respective spider arm along said generally radial mounting line axis thereof.

3. The spider construction of claim 1 wherein each fan blade is of such flexible property that it will flex from its normal configuration under the action of dynamic forces along a bend line parallel to its respective spider arm generally radial mounting line axis and intersecting its root section.

4. The spider construction of claim 3 wherein each spider arm is of an arched cross-section having an offset edge portion underlying said bend line.

5. The spider construction of claim 1 wherein each fan blade has a leading edge disposed substantially parallel to its respective spider arm generally radial mounting line axis.

6. The spider construction of claim 1 wherein each fan blade is disposed entirely radially outwardly of said root section of its respective spider arm.

* * * * *